United States Patent [19]

Simjian

[11] 4,391,441

[45] Jul. 5, 1983

[54] EXERCISE APPARATUS

[76] Inventor: Luther G. Simjian, 1750 S. Ocean La., Fort Lauderdale, Fla. 33316

[21] Appl. No.: 314,173

[22] Filed: Oct. 23, 1981

Related U.S. Application Data

[62] Division of Ser. No. 196,849, Oct. 14, 1980, Pat. No. 4,313,603.

[51] Int. Cl.[3] ..... A63B 23/02

[52] U.S. Cl. ..... 272/126; 272/146

[58] Field of Search ..... 272/146, 144, 145, 126, 272/72, 73, 137, 138, 14; 128/25 R; 280/217, 220–223, 227, 229, 242 R, 244, 249, 252, 253, 259

[56] References Cited

U.S. PATENT DOCUMENTS

| | | | |
|---|---|---|---|
| 1,952,830 | 3/1934 | Wrobley | 272/126 |
| 1,975,382 | 10/1934 | Wrobley | 272/126 |
| 2,226,881 | 12/1940 | Voiles | 128/25 R |
| 2,453,771 | 11/1948 | White | 128/25 R |
| 2,603,483 | 7/1952 | Hughes | 272/128 |
| 2,906,532 | 9/1959 | Echols | 272/146 |
| 3,566,861 | 3/1971 | Weiss | 272/126 X |
| 3,784,193 | 1/1974 | Simjian | 272/146 |

FOREIGN PATENT DOCUMENTS

| | | | |
|---|---|---|---|
| 1201861 | 7/1959 | France | 272/126 |
| 52-17926 | 10/1977 | Japan | 272/146 |

*Primary Examiner*—Richard J. Johnson

[57] ABSTRACT

An exercise apparatus comprises a stationary support which mounts a platform for oscillating rotating motion. Arm exercising means are mounted forward of the platform and are coupled to the platform to oscillatingly move toward and away from the platform responsive to oscillating rotational motion of the platform.

5 Claims, 5 Drawing Figures

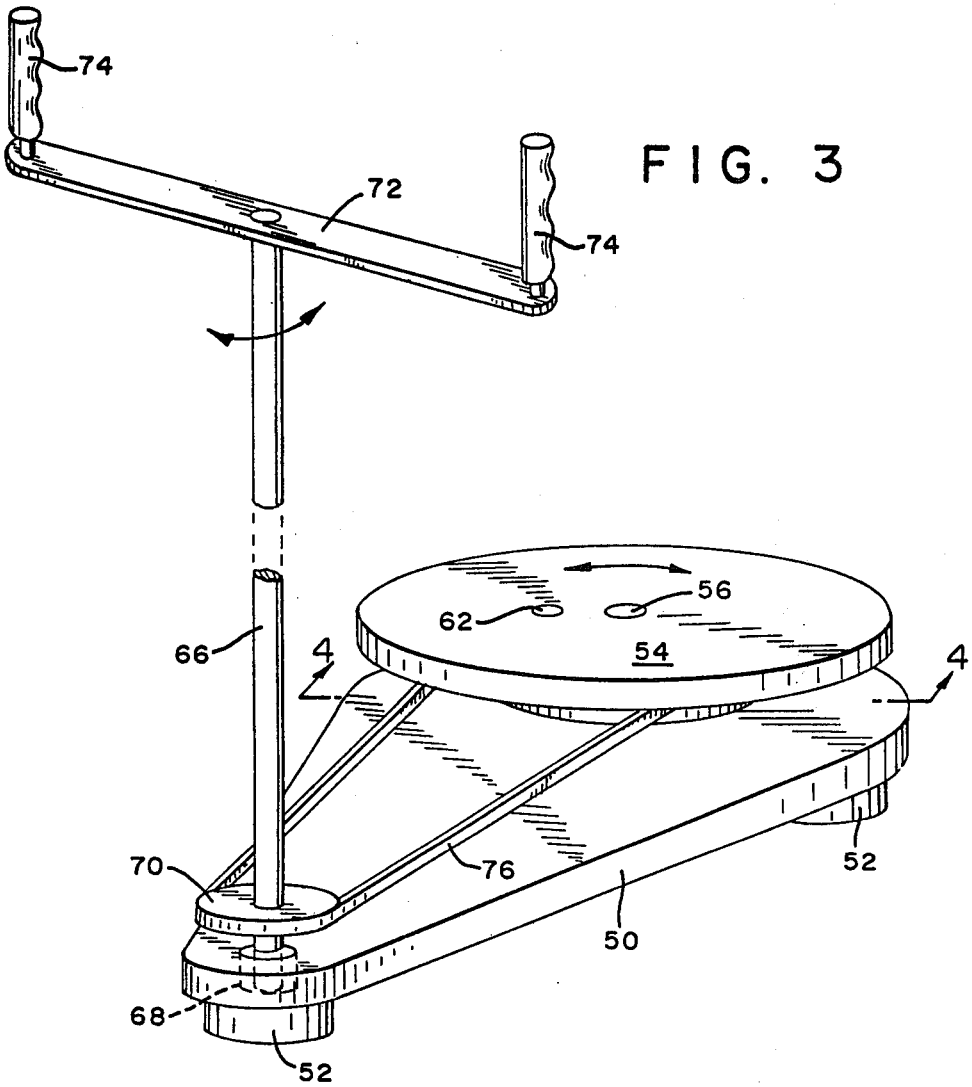
FIG. 3
FIG. 4
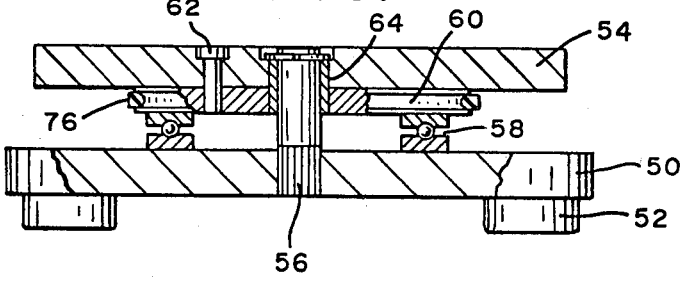

EXERCISE APPARATUS

This application is a division of application Ser. No. 196,849 filed Oct. 14, 1980 now U.S. Pat. No. 4,313,603 issued Feb. 2, 1982.

BRIEF SUMMARY OF THE INVENTION

This invention relates to exercise apparatus and, more specifically, refers to an exercise apparatus wherein body muscles and arm muscles are exercised in coordinated motion. Quite specifically, the present invention discloses an exercise apparatus wherein a person mounts a platform and responsive to a twisting motion initiated by hip movement a post in front of the platform and grasped by the person moves in coordinated motion either toward or away from the platform.

In my prior U.S. Pat. No. 3,784,193 entitled "Friction Type Exercising Device with Separate Handgrip Exerciser" dated Jan. 8, 1974, there is disclosed a similar apparatus comprising a rotatably mounted platform and an upstanding post. However, the platform and post rotate in opposite directions, that is, both undergo a coordinated counter rotational motion. In the present invention, the arm of the person standing on the platform is exercised by motion toward and away from his body as the platform undergoes oscillating rotating motion.

It is an object of this invention, therefore, to provide a novel and useful exercise apparatus.

It is another important object of this invention to provide an exercise apparatus which provides coordinated exercise for the body muscles and arm muscles of a person using this apparatus.

It is a further object of this invention to provide an exercise apparatus comprising a platform mounted for reciprocating rotational motion and means for producing coordinated oscillating motion to the arm muscle of a person standing on the platform and holding on to the post and hand grip means disposed in front of the perimeter of the platform.

Still further and other important objects of this invention will be more clearly apparent from the following description when taken in conjunction with the accompanying drawings.

BRIEF DESCRIPTION OF THE DRAWINGS

FIG. 3 is a perspective view of another embodiment of the exercise apparatus;

FIG. 4 is a sectional view along line 4—4 in FIG. 3, and

DETAILED DESCRIPTION OF THE INVENTION

Figure 1:
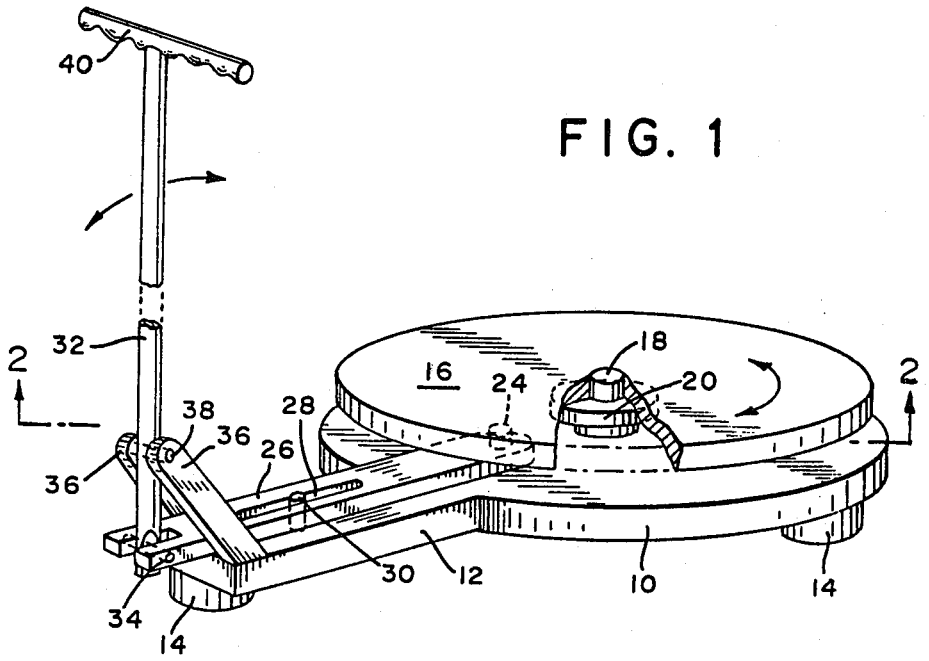
FIG. 1 is a perspective view of a first preferred embodiment of the exercise apparatus.
Figure 2:
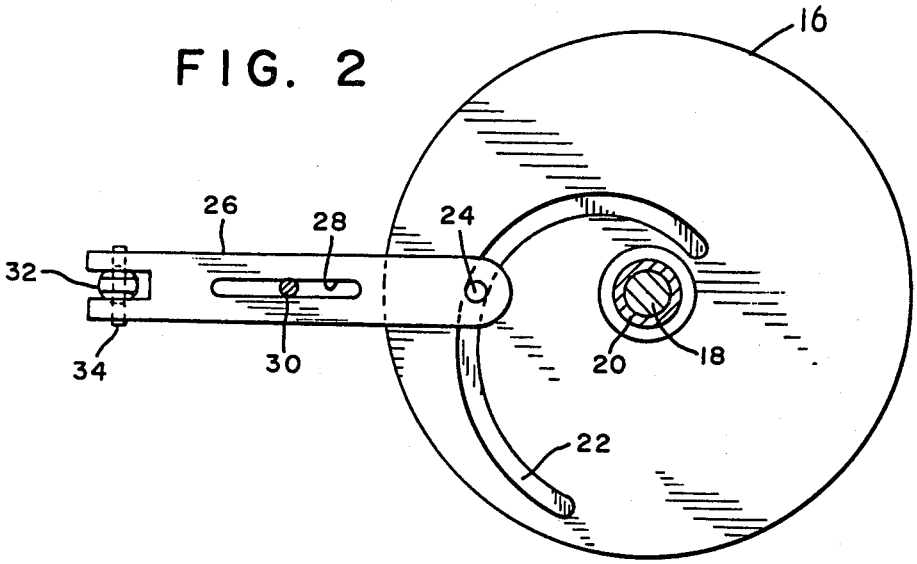
FIG. 2 is a sectional view along line 2—2 in FIG. 1.

Referring now to the figures and FIGS. 1 and 2 in particular, there is shown a stationary support 10 which is provided with a forward extension 12 and three feet 14, only two being visible. A circular platform 16 is disposed above the support 10 and is mounted for oscillating rotating motion about its centrally disposed axis by virtue of a central shaft 18 which is surrounded by a spacer bushing 20. The bushing 20 is provided with a horizontal flange at its upper end for engaging and supporting the underside of the platform 16. Also the bushing provides the space between the support 10 and the platform 16.

The underside of the platform 16 is provided with an eccentric circular groove 22 which is engaged by a travelling pin or cam follower 24 that is coupled to a linearly moving horizontally disposed slide 26. The right end (FIG. 1) of the slide 26 slides in the space between the support 10 and the platform 16. The linear motion of the slide 26 is assured by a linear groove 28 of the slide 26 and a stationary pin 30 upstanding from the support extension 12. The forward end of slide 26 is bifurcated to mount an upstanding post 32. The lower end of the post 32 is secured to the bifurcated end of the slide by a pin 34. The upstanding post 32 is supported from the support by means of a pair of inclined braces 36, upstanding from the forward end of the extension 12, and a pivot pin 38. The upper end of the post 32 is provided with a horizontally disposed handle bar 40 which may be fitted with hand grips.

Operation of the foregoing apparatus will be apparent from the following description. A person wishing to exercise mounts the flat platform 16 and holds on to the handle bar 40 with his arms. As he performs a twisting hip motion, the platform 16 rotates by a certain angle. Rotation of the platform, assuming in clockwise direction, causes linear motion of the slide 26 relative to the center of the platform 16, which motion causes the upper end of the post 32 to move outwardly, the post 32 pivoting about the pivotal axis defined by the pin 38. Hence, oscillating rotating motion of the platform 16 causes concomitant pivotal motion of the post 32, that is, the upper end of the post alternately moves toward and away from the perimeter of the platform 16.

It will be understood that the groove and pin mechanism may be replaced by a cam and cam follower mechanism.

FIGS. 3 and 4 show a somewhat modified arrangement. A stationary, triangularly shaped, support 50 with feet 52 supports a platform 54. Such support is achieved by means of a stationary pin 56 extending from the support 50, a ball bearing 56, and a pulley 60 in contact with the underside of the platform 54. The platform 54 is coupled to the pulley 60 by means of a headed pin 62 to assure concomitant rotation of the platform and pulley. A sleeve bearing 64 provides rotation of the platform 54 about the centrally disposed pin 56.

Forward of the platform 54 there is mounted an upstanding post or shaft 66. The lower end of the shaft 66 is supported by the base 50 in bearing means 68. The shaft 66 is provided also with a pulley 70 affixed to the shaft 66 and a horizontally disposed handle 72 having a set of vertically disposed hand grips 74. Pulleys 60 and 70 are coupled to one another by means of a drive belt 76. Alternatively, sprockets and a chain connecting the sprockets may be used.

It will be apparent that oscillating rotational motion imparted to the platform 54 will cause oscillating rotational motion of the shaft 66 by virtue of the pulley and belt connection between the platform 54 and shaft 66, thereby causing the shaft to oscillatingly rotate about its central axis. Oscillating rotational motion of the shaft 66 causes the hand grips 74 at the upper end of the shaft to alternatingly move toward and away from the platform perimeter.

A further embodiment per FIG. 5, once again, illustrates a stationary support 80 and a platform 82 disposed thereabove. The platform 82 is spaced above the support and the space therebetween is occupied by a pulley, not visible. The pulley is coupled for rotation with the platform 82 which rotates about its center by virtue of centrally located shaft 84. The pulley coupled to the platform 82 is coupled, moreover, via a drive belt 86 to a pulley 88 which is affixed to a vertical shaft 90, the latter being mounted for rotation in bearing means 92 which are disposed in an extension 94 extending forwardly from the stationary support 80. Affixed to the shaft 90 is a horizontally disposed cross bar 96 which is provided at either end with a respective slotted bracket 98. A pair of vertically disposed posts 100 is pivotally supported from the support 80 by means of respective inclined stationary brackets 102 and pivot pins 104.

The lower ends of the posts 100 are provided with respective depending pins 106 which extend through the elongated slots of brackets 98 of the cross bar 96. The upper ends of the posts 100 are fitted with respective hand grips 110.

Figure 5:
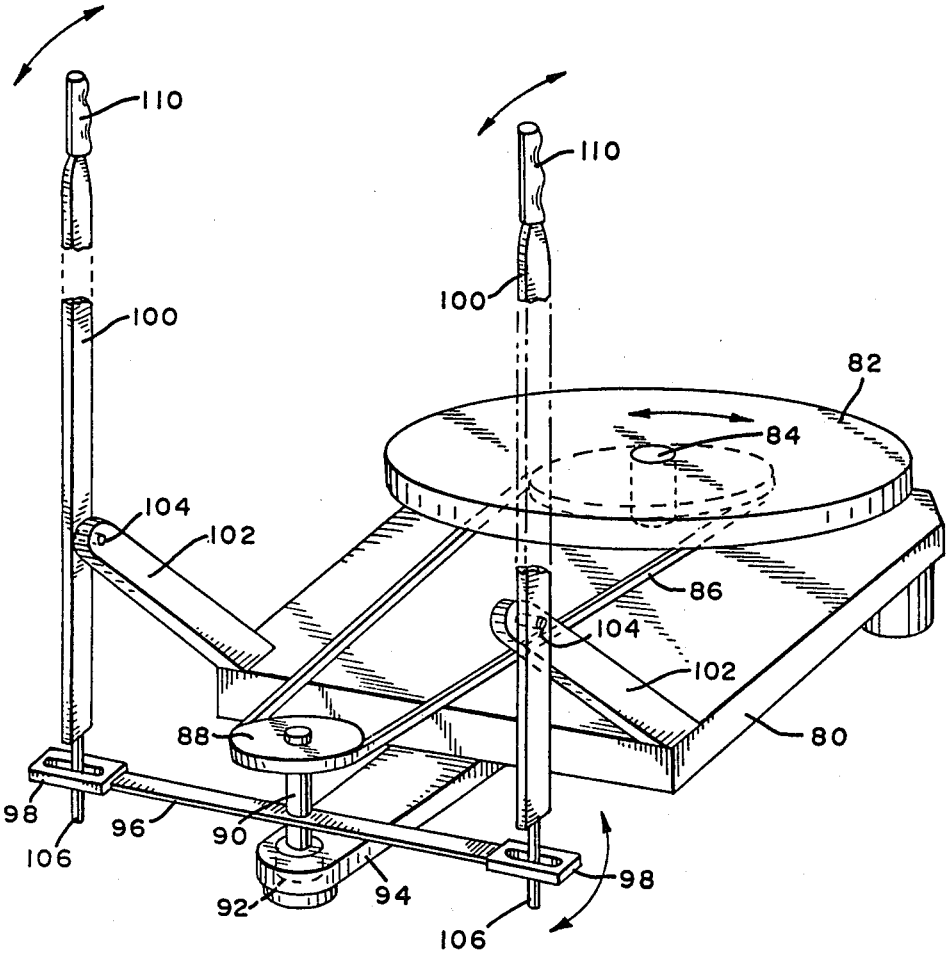
FIG. 5 is a perspective view of a still further embodiment of the exercise apparatus according to the present invention.

Operation of the embodiment per FIG. 5 may be visualized as follows: Responsive to oscillating rotational motion of the platform 82, the belt 86 drives pulley 88 which, in turn, drives the shaft and causes pivotal motion of the horizontally disposed cross bar 96 about the center of the shaft 90. The oscillating cross bar 96, via brackets 98 and pins 106, causes pivotal motion of the posts 100 which are pivotally supported by respective pins 104. The upper ends of the posts 100 move alternatingly toward and away from the perimeter of the platform 82 as the platform undergoes oscillating rotating motion. Hence, the arms of the person standing on the platform are exercised simultaneously as he executes a twisting hip motion.

It will be understood that the rotational motion of the platform may be limited by suitable stop means or brake means. Similarly, motor means may be used to assist the motion of the platform, or conversely friction means may be used to vary the physical effort required to obtain rotation of the platform. However, in all cases motion of the platform causes coordinated motion of the upstanding arm or shaft and the associated hand grip means.

While there have been described and illustrated several preferred embodiments of my invention, it will be apparent to those skilled in the art that several modifications may be made without departing from the principle and teachings of this invention which shall be limited only by the scope of the appended claims.

What is claimed is:

1. An exercise apparatus comprising:

a stationary support;

a platform mounted upon said support for oscillating rotating motion about a centrally disposed axis and adapted to support a person in standing position;

a pair of upstanding posts mounted forward of the perimeter of said platform and pivotally supported for enabling the upper end of each post to undergo oscillating motion in a direction generally toward and away from said platform, and means coupling said platform to said posts for causing the upper ends of said posts to move in opposition relative to each other toward and away from said platform responsive to oscillating motion imparted to said platform.

2. An exercise apparatus as set forth in claim 1, said means coupling comprising a pivotally mounted cross bar; the lower ends of said posts coupled to a respective end of said cross bar, and drive means coupling said cross bar to said platform to cause oscillating pivotal motion of said cross bar responsive to oscillating rotating motion of said platform.

3. An exercise apparatus comprising:

a stationary support;

a platform mounted upon said support for oscillating rotating motion and adapted to support a person;

a pair of upstanding posts mounted forward of the perimeter of said platform and pivotally supported for enabling the upper end of each post to undergo oscillating motion in a direction generally toward and away from said platform;

coupling means which include a cross bar pivotally mounted substantially medially between its ends coupling said platform to said posts; the lower ends of said posts coupled to a respective end of said cross bar;

means supporting said cross bar from said support, and drive means which include pulley and belt means coupling said cross bar to said platform to cause oscillating pivotal motion of said cross bar responsive to oscillating rotating motion of said platform for effecting the upper ends of said posts to move in opposition relative to each other toward and away from said platform.

4. An exercise apparatus as set forth in claim 3, said cross bar being affixed to a vertically disposed shaft; a first pulley affixed to said shaft, a second pulley being driven by the rotation of said platform, a belt coupling said first pulley and said second pulley to one another, and bracket means extending from said support for pivotally supporting each of said posts at a location between the lower end and the upper end of each post.

5. An exercise apparatus as set forth in claim 4 and a hand grip disposed at the respective upper end of each post.

* * * * *